US009209541B2

(12) United States Patent
Miyazaki

(10) Patent No.: US 9,209,541 B2
(45) **Date of Patent: *Dec. 8, 2015**

(54) CONNECTOR AND SOCKET FOR USE IN THE SAME

(71) Applicant: Panasonic Intellectual Property Management Co., Ltd., Osaka (JP)

(72) Inventor: Yoji Miyazaki, Mie (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/630,294

(22) Filed: Feb. 24, 2015

(65) Prior Publication Data

US 2015/0171533 A1 Jun. 18, 2015

Related U.S. Application Data

(62) Division of application No. 13/879,775, filed as application No. PCT/JP2011/073211 on Oct. 7, 2011, now Pat. No. 8,992,233.

(30) Foreign Application Priority Data

Oct. 19, 2010 (JP) ..... 2010-234717

(51) Int. Cl.
*H01R 24/00* (2011.01)
*H01R 12/71* (2011.01)
(Continued)

(52) U.S. Cl.
CPC ..... *H01R 12/716* (2013.01); *H01R 12/707* (2013.01); *H01R 12/71* (2013.01); *H01R 13/20* (2013.01)

(58) Field of Classification Search
CPC ..... H01R 12/716
USPC ..... 439/65, 74, 660
See application file for complete search history.

(56) References Cited

U.S. PATENT DOCUMENTS 5,626,482 A 5/1997 Chan et al.
7,367,816 B2 5/2008 Liu
7,425,158 B2 * 9/2008 Ookura ..... 439/660
(Continued)

FOREIGN PATENT DOCUMENTS

CN 101820114 A 9/2010
JP 2002-033145 A 1/2002
(Continued)

OTHER PUBLICATIONS

International Search Report mailed Jan. 10, 2012 issued in corresponding International Application No. PCT/JP2011/073211.
(Continued)

*Primary Examiner* — Tho D Ta
(74) *Attorney, Agent, or Firm* — McDermott Will & Emery LLP

(57) ABSTRACT

A connector that electrically connects circuit boards to each other by fitting a header and a socket to each other, the connector including: header holding fixtures for holding the header to the circuit board; and a socket molded article as a molded article of the socket, wherein recessed portions with a recessed shape are formed on the socket molded article so that soldering terminals of the header holding fixtures cannot interfere with the socket molded article when the header and the socket are fitted to each other.

7 Claims, 7 Drawing Sheets

(51) Int. Cl.
*H01R 12/70* (2011.01)
*H01R 13/20* (2006.01)

(56) References Cited

U.S. PATENT DOCUMENTS

| | | | |
|---|---|---|---|
| 8,272,881 | B2 | 9/2012 | Miyazaki et al. |
| 2004/0102065 | A1 | 5/2004 | Obikane et al. |
| 2010/0221928 | A1 | 9/2010 | Sato et al. |

FOREIGN PATENT DOCUMENTS

| | | | |
|---|---|---|---|
| JP | 2006-210206 | A | 8/2006 |
| JP | 2008-218095 | A | 9/2008 |
| JP | 2008-243703 | A | 10/2008 |
| JP | 2009-231046 | A | 10/2009 |
| JP | 2009-283357 | A | 12/2009 |
| TW | 595051 | B | 6/2004 |

OTHER PUBLICATIONS

Office Action issued in U.S. Appl. No. 13/879,775, dated Aug. 5, 2014.

Notice of Allowance issued in U.S. Appl. No. 13/879,775, dated Nov. 24, 2014.

Chinese Search Report issued in Chinese Application No. 201180049995.5 dated Jun. 16, 2015, with English Translation.

* cited by examiner

CONNECTOR AND SOCKET FOR USE IN THE SAME

CROSS REFERENCE TO RELATED APPLICATIONS

The present application is a Divisional of U.S. application Ser. No. 13/879,775, filed on Apr. 16, 2013, now U.S. Pat. No. 8,992,233, which is the U.S. National Phase under 35 U.S.C. §371 of International Application No. PCT/JP2011/073211, filed on Oct. 7, 2011, which claims priority to Japanese Patent Application No. 2010-234717 filed on Oct. 19, 2010, the disclosures of which applications are incorporated herein by reference in their entirety.

TECHNICAL FIELD

The present invention relates to a connector that electrically connects circuit boards to each other, and to a socket for use in the same.

BACKGROUND ART

Heretofore, a connector, which electrically connects circuit boards to each other, has been known (refer to Patent Literature 1). That is to say, a header mounted on one of the circuit boards and a socket mounted on the other circuit board are fitted to each other, whereby contacts corresponding thereto are brought into contact with and conducted to each other, and conductor patterns of the circuit boards to which the respective contacts are connected are electrically connected to each other. Holding fixtures of the header are soldered to the circuit board, whereby bonding strength between the header and the circuit board is enhanced.

CITATION LIST

Patent Literature

[PTL 1] Japanese Patent Laid-Open Publication No. 2009-231046

SUMMARY OF INVENTION

Incidentally, with a tendency of thinning a portable instrument in recent years, it is required to lower a height of the connector. However, heretofore, it has been difficult to realize a low-height connector while ensuring soldering strength. That is to say, as shown in FIG. 6(*a*), in the case where soldering terminals of holding fixtures 240 of a header 200 are shorter than soldering terminals 220T of header contacts, then as shown in FIG. 6(*b*), since the holding fixtures 240 of the header 200 are short, sufficient soldering strength cannot be ensured. Likewise, in the case where the soldering terminals of the holding fixtures 240 of the header 200 have an I-terminal shape, there is a problem that the sufficient soldering strength cannot be ensured either.

Meanwhile, in the case where the soldering terminals of the holding fixtures 240 of the header 200 have the same length as a length of the soldering terminals 220T of the header contacts, then as shown in FIG. 7(*b*), an inviting shape 170 of a socket 100 sacrifices. That is to say, in this case, the soldering strength is also increased by an amount that the holding fixtures 240 of the header 200 are lengthened; however, fitting workability is deteriorated since tapers of such invitations become small.

The present invention has been made in order to solve the above-described problems. It is an object of the present invention to provide a low-height connector and a socket for use in the same while ensuring the soldering strength and the fitting workability.

A connector according to a first aspect of the present invention is a connector that electrically connects circuit boards to each other by fitting a header and a socket to each other, the connector including: header holding fixtures for holding the header on the circuit board; and a socket molded article as a molded article of the socket, wherein recessed portions with a recessed shape are formed on the socket molded article so that soldering terminals of the header holding fixtures cannot interfere with the socket molded article when the header and the socket are fitted to each other.

A connector according to a second aspect of the present invention is characterized in that the soldering terminals of the header holding fixtures have the same length as a length of soldering terminals of header contacts electrically connected to the circuit board.

A connector according to a third aspect of the present invention is characterized in that the header holding fixtures are manufactured by using the same components as those of the header contacts electrically connected to the circuit board.

A connector according to a fourth aspect of the present invention is characterized in that the recessed shape of the socket molded article has a tapered shape or an R-shape.

A socket according to a fifth aspect of the present invention is a socket characterized in being used for the connector according to any one of the first to fourth aspects.

BRIEF DESCRIPTION OF DRAWINGS

FIG. 1(*a*) is an overall perspective view of a socket; and FIG. 1(*b*) is an overall perspective view of a header.

FIG. 2(*a*) is an overall perspective view of the socket; FIG. 2(*b*) is a view from an arrow A of the socket; and FIGS. 2(*c*) and 2(*d*) are enlarged views of each of the recessed portions.

FIG. 3(*a*) is an overall perspective view of the socket; and FIG. 3(*b*) is an overall perspective view of the header.

FIG. 4(*a*) is a cross-sectional view of the socket; and FIGS. 4(*b*) and 4(*c*) are cross-sectional views of the header.

FIG. 5(*a*) is a cross-sectional view when the socket and a header for a height of 1.0 mm are fitted to each other; FIG. 5(*b*) is a cross-sectional view when the socket and a header for a height of 1.5 mm are fitted to each other.

FIG. 6(*a*) is an overall perspective view thereof; and FIG. 6(*b*) is a cross-sectional view thereof.

FIG. 7(*a*) is an overall perspective view thereof; and FIG. 7(*b*) is a cross-sectional view thereof.

DESCRIPTION OF EMBODIMENTS

A description is made below in detail of embodiments of the present invention with reference to the drawings.

Figure 1A:
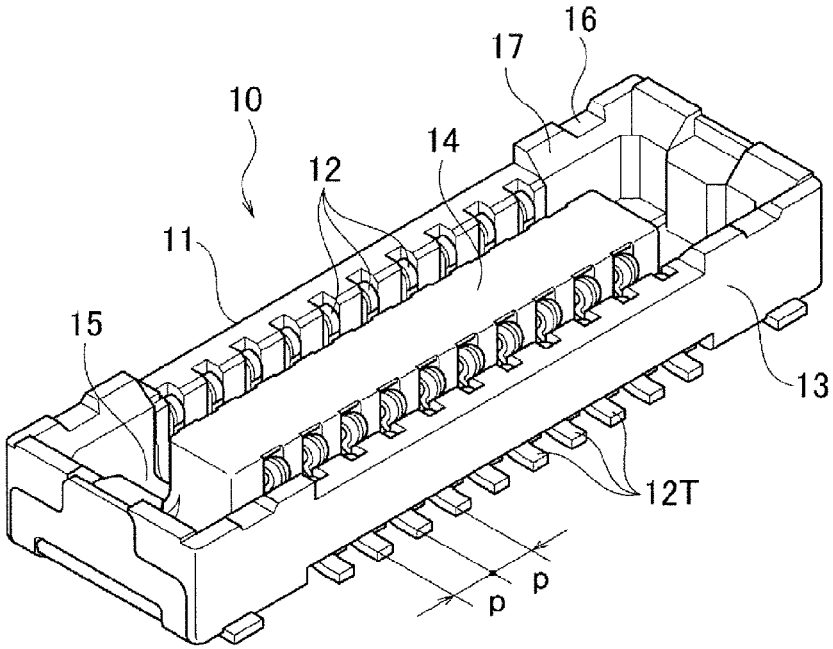
FIGS. 1(*a*) and 1(*b*) are views showing a connector of this embodiment.
Figure 1B:
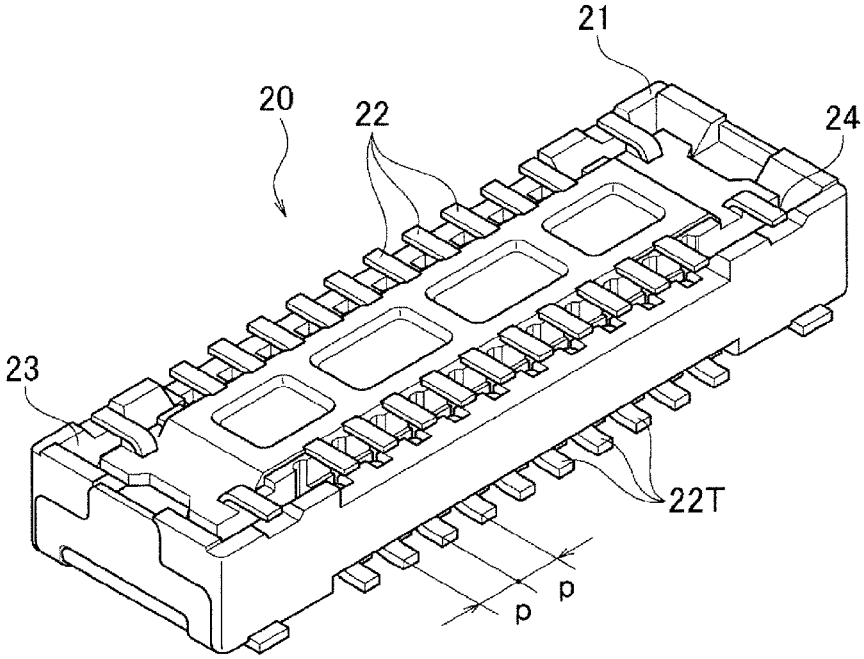
Figure 2A:
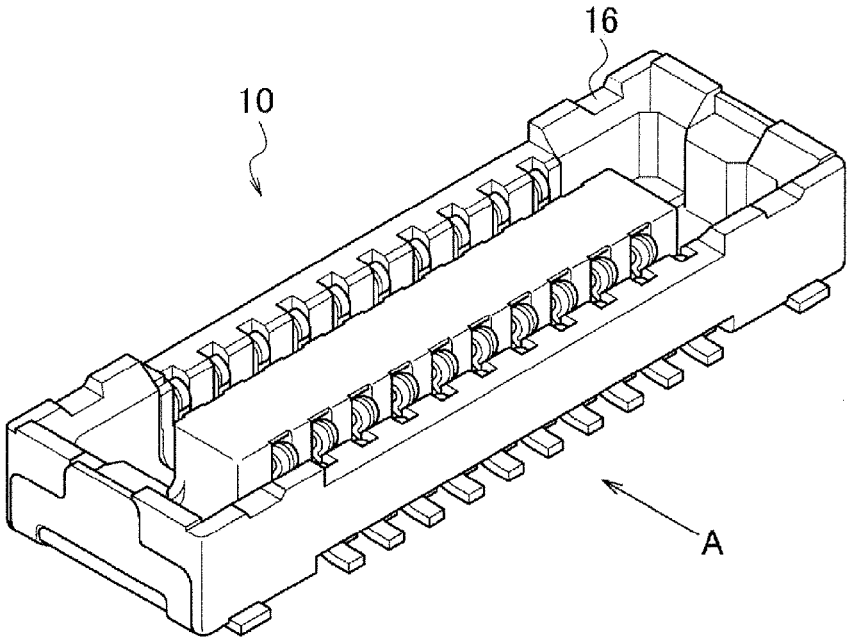
FIGS. 2(*a*) to 2(*d*) are views for explaining in detail recessed portions formed on the socket of this embodiment.
Figure 2B:
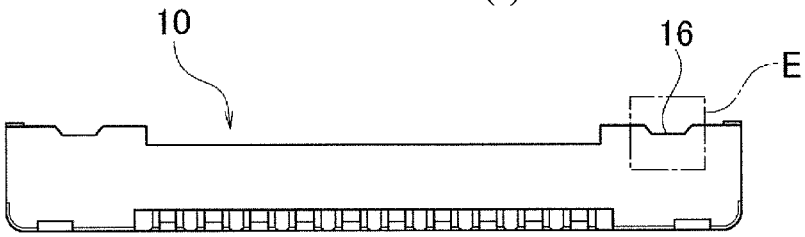
Figure 2C:
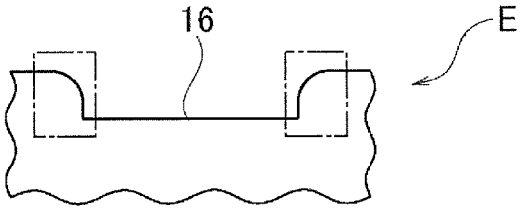
Figure 2D:
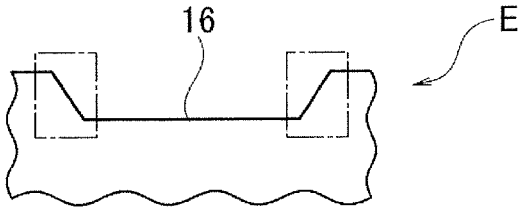

FIG. 1(*a*) is an overall perspective view of a socket 10 of this embodiment. As shown in this drawing, the socket 10 includes a socket molded article 11 molded of insulating synthetic resin into a rectangular shape as a whole. The socket molded article 11 includes: a peripheral wall portion 13 formed along a peripheral edge portion thereof; and an island portion 14 formed on a center portion thereof. Between the peripheral wall portion 13 and the island portion 14, a fitting groove portion 15 that fits a header 20 thereto is formed. In a longitudinal direction of the socket molded article 11, a plurality of socket contacts 12 are attached at a predetermined pitch p. The socket contacts 12 are belt-like metal members having a predetermined thickness. Connection terminal portions 12T of the socket contacts 12 protrude outward from a lower edge of the peripheral wall portion 13, and are soldered to a conductor pattern of a circuit board (not shown). On both end portions in the longitudinal direction of the socket molded article 11, recessed portions 16 with a recessed shape are formed so that soldering terminals (described later) of header holding fixtures 24 cannot interfere with the socket molded article 11. In other words, in the socket 10, the recessed portions 16, which accept the soldering terminals of the header holding fixtures 24 when the header 20 and the socket 10 are fitted to each other, are provided on portions thereof corresponding to the soldering terminals concerned. In this embodiment, as shown in FIG. 1(*a*), the recessed portions 16 are provided on both end portions in the longitudinal direction of the socket molded article 11. In such a way, the soldering terminals of the header holding fixtures 24 do not interfere with the socket molded article 11, and accordingly, inviting tapers 17 can be ensured with a sufficient size.

FIG. 1(*b*) is an overall perspective view of the header 20 of this embodiment. As shown in this drawing, the header 20 includes a header molded article 21 molded of insulating synthetic resin into a rectangular shape substantially similar to that of the socket molded article 11 as a whole. The header molded article 21 includes a peripheral wall portion formed along a peripheral edge portion thereof. In a longitudinal direction of the header molded article 21, a plurality of header contacts 22 are attached at a pitch p equal to the pitch p of the socket contacts 12. The header contacts 22 are belt-like metal members having a predetermined thickness like the socket contacts 12. Connection terminal portions 22T of the header contacts 22 protrude outward from a lower edge of the peripheral wall portion 23 and are soldered to a conductor pattern of a circuit board (not shown). To both end portions in the longitudinal direction of the header molded article 21 are attached the header holding fixtures 24 formed by performing press molding for metal plates with a predetermined thickness. The soldering terminals of the header holding fixtures 24 are soldered to the circuit board (not shown), and in combination with the fact that the connection terminal portions 22T of the header contacts 22 are soldered, the header 20 is strongly bonded to the circuit board.

FIGS. 2(*a*) to (*d*) are views for explaining in detail the recessed portions 16 formed on the socket 10. That is to say, FIG. 2(*a*) is an overall perspective view of the socket 10, FIG. 2(*b*) is a view from an arrow A of the socket 10 shown in FIG. 2(*a*), and FIGS. 2(*c*) and 2(*d*) are enlarged views of the recessed portion 16 in a region E shown in FIG. 2(*b*). As already explained, the recessed portion 16 is to prevent the soldered terminals of the header holding fixtures 24 from interfering with the socket molded article 11. The recessed shape of this recessed portion 16 may be an R-shape as shown by dotted lines in FIG. 2(*c*), or alternatively, may be a tapered shape as shown by dotted lines in FIG. 2(*d*). In such a way, a thickness of a portion of each dotted line can be ensured, and accordingly, strength of the socket molded article 11 can be maintained to be high.

Figure 3A:
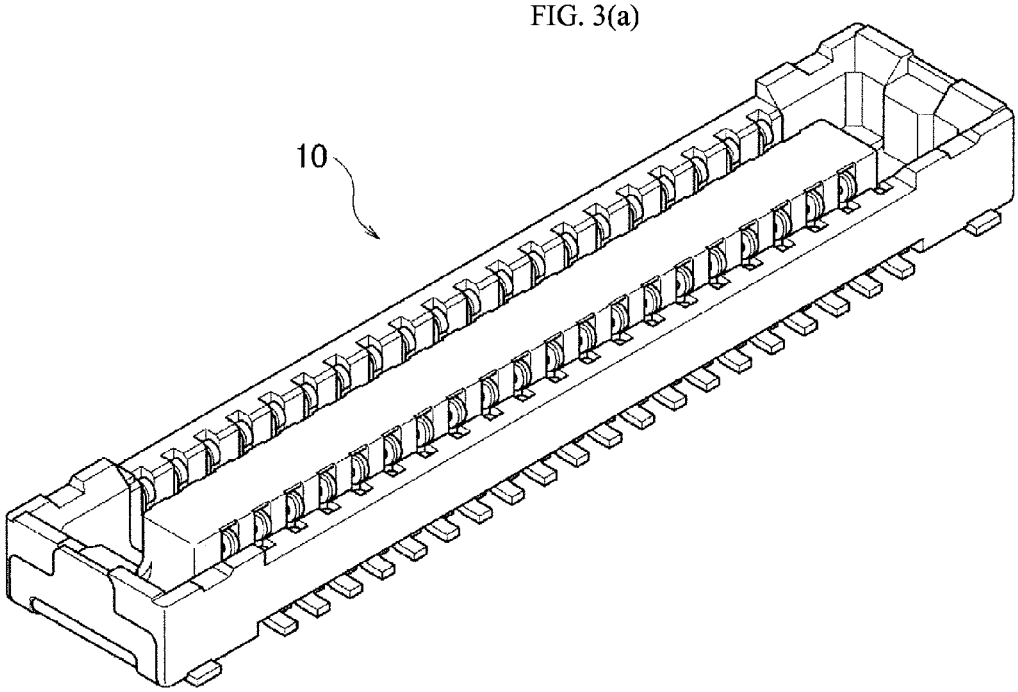
FIGS. 3(*a*) and 3(*b*) are views showing specific examples of the socket and header of this embodiment.
Figure 3B:
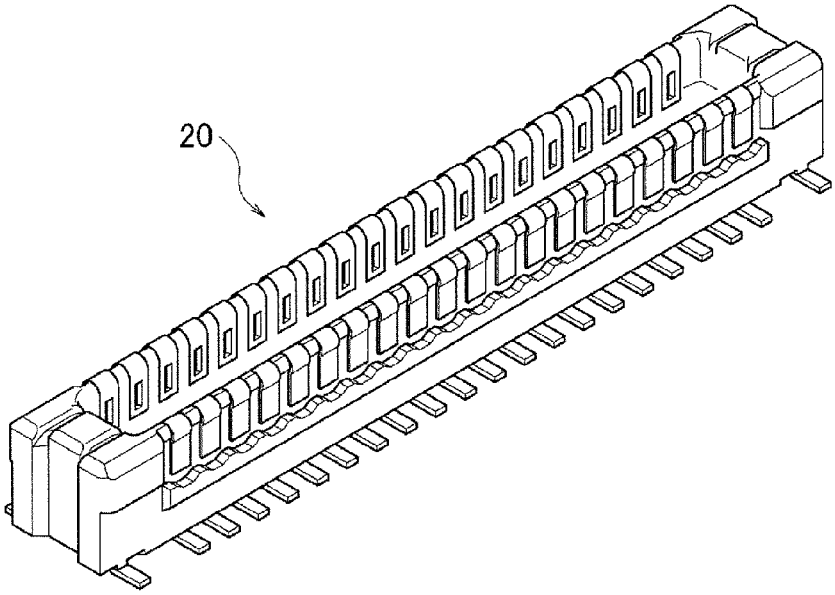
Figure 4A:
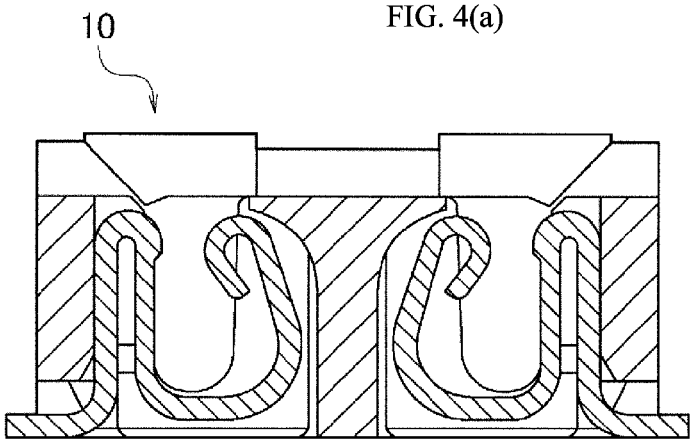
FIGS. 4(*a*) to 4(*c*) are views showing specific examples of the socket and header of this embodiment.
Figure 4B:
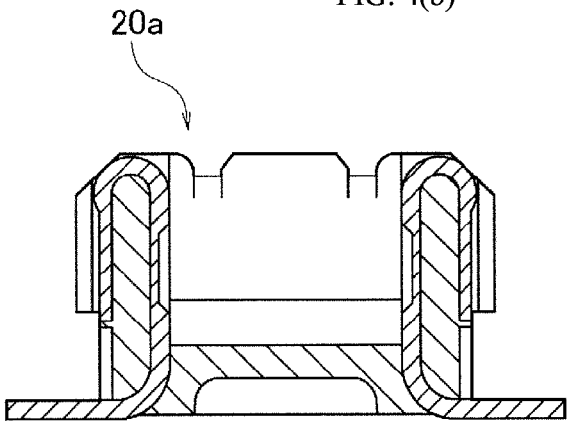
Figure 4C:
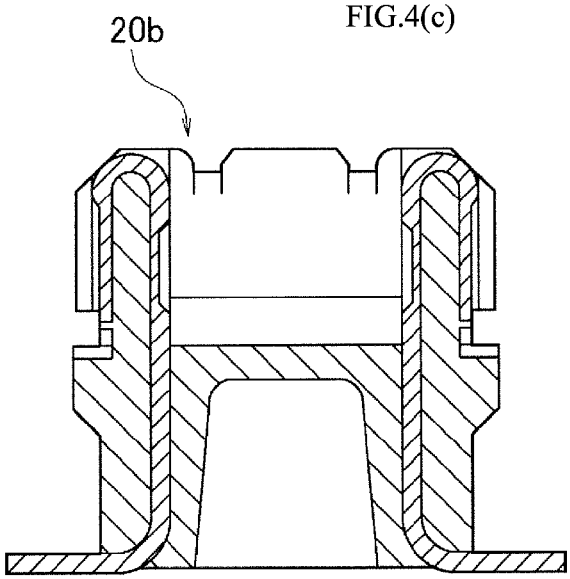
Figure 5A:
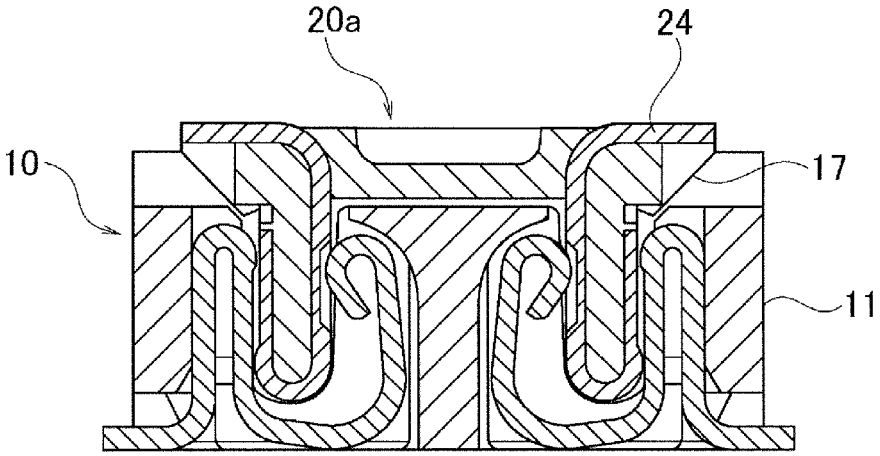
FIGS. 5(*a*) and 5(*b*) are cross-sectional views when the socket and header of this embodiment are fitted to each other.
Figure 5B:
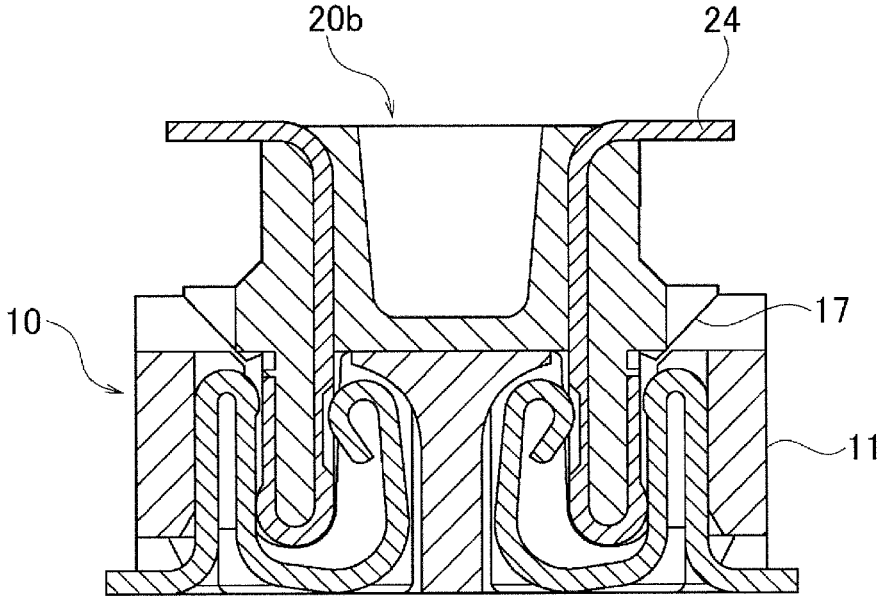
Figure 6A:
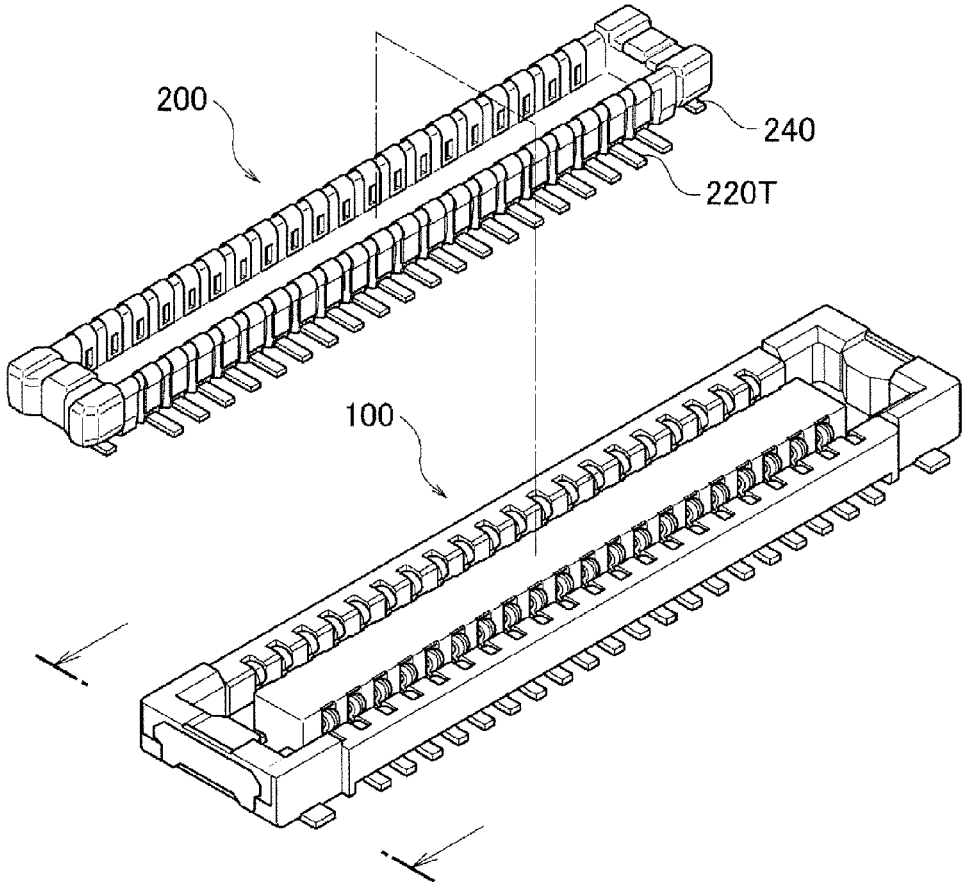
FIG. 6(a) PRIOR ART
FIGS. 6(*a*) and 6(*b*) are views showing a conventional connector.
Figure 6B:
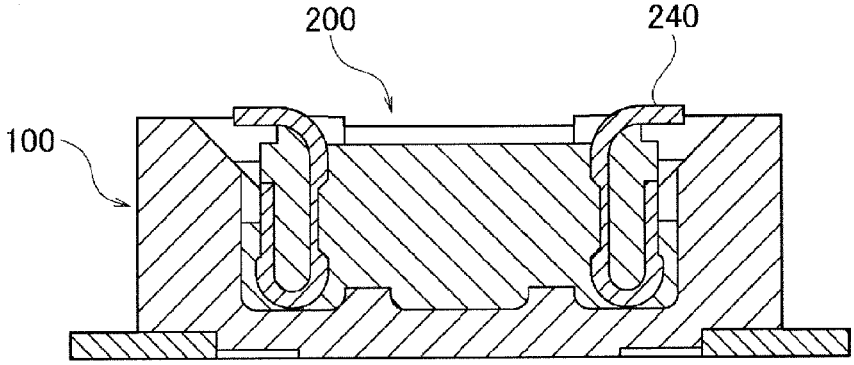
FIG. 6(b) PRIOR ART
Figure 7A:
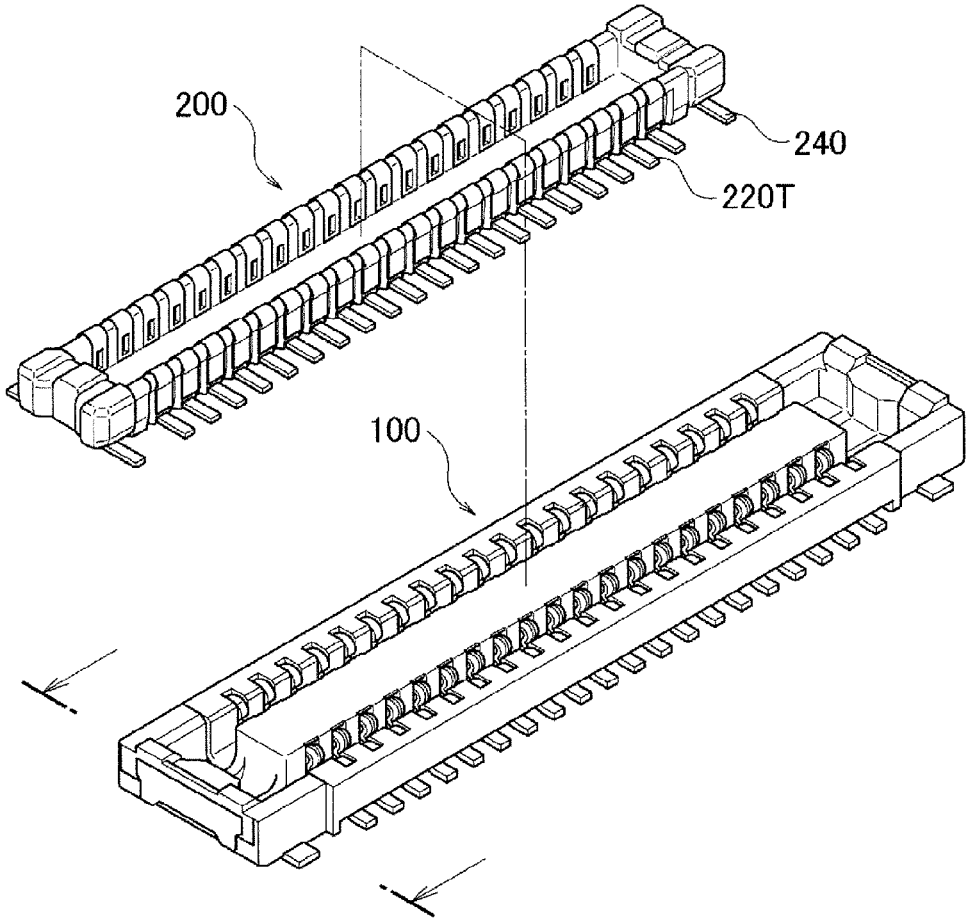
FIG. 7(a) PRIOR ART
FIGS. 7(*a*) and 7(*b*) are views showing another conventional connector.
Figure 7B:
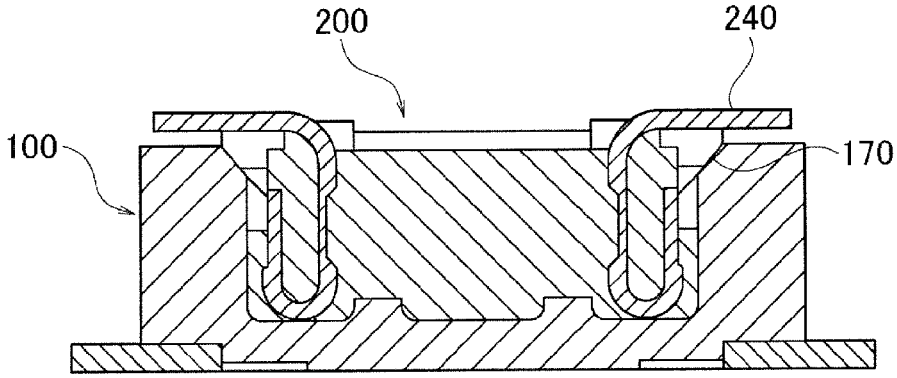
FIG. 7(b) PRIOR ART

FIG. 3 and FIG. 4 are views showing specific examples of the socket 10 and the header 20. That is to say, FIG. 3(*a*) is an overall perspective view of the socket 10, and FIG. 3(*b*) is an overall perspective view of the header 20. It is assumed that, as this header 20, there are two types, which are: a header 20*a* for a height of 1.0 mm; and a header 20*b* with a height of 1.5 mm. That is to say, FIG. 4(*a*) is a cross-sectional view of the socket 10 shown in FIG. 3(*a*), FIG. 4(*b*) is a cross-sectional view of the header 20*a* for the height of 1.0 mm, which is shown in FIG. 3(*b*), and FIG. 4(*c*) is a cross-sectional view of the header 20*b* for the height of 1.5 mm, which is shown in FIG. 3(*b*). Moreover, FIG. 5(*a*) shows a cross-sectional view when the socket 10 and the header 20*a* for the height of 1.0 mm are fitted to each other, and FIG. 5(*b*) shows a cross-sectional view when the socket 10 and the header 20*b* for the height of 1.5 mm are fitted to each other. As shown in these drawings, with the socket 10 as a common component, it is possible to cope with two or more types of fitting heights, which are caused by difference in the headers. It is understood that, in either case, the header holding fixtures 24 do not interfere with the socket molded article 11, and the inviting tapers 17 have a sufficient size.

As described above, in the connector of this embodiment, the recessed portions 16 with the recessed shape are formed on the socket molded article 11 so that the soldering terminals of the header holding fixtures 24 cannot interfere with the socket molded article 11 when the header 20 and the socket 10 are fitted. In such away, it is possible to provide a connector with a low-height (for example, a height of 1.5 mm or less) while ensuring soldering strength and fitting workability.

Moreover, in the connector of this embodiment, the soldering terminals of the header holding fixtures 24 have the same length as that of the soldering terminals of the header contacts 22. In such a way, the header holding fixtures 24 and the header contacts 22 can be cut simultaneously, thereby simplifying the process and stabilizing the dimensions.

Moreover, in the connector of this embodiment, the header holding fixtures 24 are manufactured by using the same components as the header contacts 22. In such a way, not only the parts count can be reduced, but also the dimensions can be stabilized since the header holding fixtures 24 and the header contacts 22 are connected to the same carrier portion 25.

Furthermore, in the connector of this embodiment, the recessed shape of the socket molded article 24 has the tapered shape or the R-shape. In such a way, it is possible to maintain the strength of the socket molded article 11 to be high.

Note that the description has been made above of the preferred embodiment; however, the present invention is not limited to the above-described embodiment, but is modifiable in various ways. For example, specifications such as the sizes and materials of the molded articles, contacts and the like of the connector are changeable as appropriate.

The entire contents of Japanese Patent Application No. 2010-234717 (filed on Oct. 19, 2010) are incorporated herein by reference.

INDUSTRIAL APPLICABILITY

The present invention is useful for application to a connector and to a socket for use in the same, the connector requiring to be low in height while ensuring the soldering strength and the fitting workability.

REFERENCE SIGNS LIST

10 Socket
11 Socket Molded Article

16 Recessed Portion
20 Header
24 Header Holding Fixture

The invention claimed is:

1. A connector that electrically connects circuit boards to each other by fitting a header and a socket to each other, the connector comprising:

header holding fixtures for holding the header on the circuit board; and a socket molded article as a molded article of the socket, wherein recessed portions with a recessed shape are formed on the socket molded article so that soldering terminals of the header holding fixtures cannot interfere with the socket molded article when the header and the socket are fitted to each other, and a lower surface of the header on which connecting terminal portions protrude from a lower edge thereof and an upper surface of the socket are placed substantially on an identical level when the header and the socket are fitted to each other.

2. The connector according to claim 1, wherein the recessed portions are formed on both end portions in a longitudinal direction of the socket, the soldering terminals of the header holding fixtures are formed on both end portions in a longitudinal direction of the header, and the soldering terminals are disposed in the recessed portions when the header and the socket are connected.

3. The connector according to claim 1, wherein second recessed portions with a recessed shape are formed on the socket molding article at portions corresponding to header contacts formed in long-side portions of the header.

4. The connector according to claim 1, wherein the soldering terminals of the header holding fixtures have the same length as a length of soldering terminals of the header contacts electrically connected to the circuit board.

5. The connector according to claim 1, wherein the header holding fixtures are manufactured by using the same components as the header contacts electrically connected to the circuit board.

6. The connector according to claim 1, wherein the recessed shape of the socket molded article has a tapered shape or an R-shape.

7. A socket used for the connector according to claim 1.

* * * * *